US007808339B2

(12) United States Patent
Kawanami

(10) Patent No.: US 7,808,339 B2
(45) Date of Patent: Oct. 5, 2010

(54) NON-RECIPROCAL CIRCUIT ELEMENT

(75) Inventor: Takashi Kawanami, Oumihachiman (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 12/495,850

(22) Filed: Jul. 1, 2009

(65) Prior Publication Data

US 2009/0261920 A1 Oct. 22, 2009

Related U.S. Application Data

(63) Continuation of application No. PCT/JP2007/072477, filed on Nov. 20, 2007.

(30) Foreign Application Priority Data

Feb. 7, 2007 (JP) ..... 2007-028390

(51) Int. Cl.
*H01P 1/36* (2006.01)

(52) U.S. Cl. ..... 333/24.2; 333/1.1

(58) Field of Classification Search ..... 333/1.1, 333/24.2

See application file for complete search history.

(56) References Cited

U.S. PATENT DOCUMENTS 7,532,084 B2 * 5/2009 Wada et al. ..... 333/24.2
2002/0014927 A1 2/2002 Makino et al.
2002/0033742 A1 3/2002 Makino et al.
2007/0046390 A1 3/2007 Soda et al.

FOREIGN PATENT DOCUMENTS

| | | | |
|---|---|---|---|
| JP | 2002-026615 | A | 1/2002 |
| JP | 2002-198707 | A | 7/2002 |
| JP | 2006-013970 | A | 1/2006 |
| JP | 2006-211373 | A | 8/2006 |
| WO | 2006/011382 | A1 | 2/2006 |
| WO | 2006/011383 | A1 | 2/2006 |

OTHER PUBLICATIONS

Official Communication issued in International Patent Application No. PCT/JP2007/072477, mailed on Jan. 29, 2008.

* cited by examiner

*Primary Examiner*—Stephen E Jones
(74) *Attorney, Agent, or Firm*—Keating & Bennett, LLP

(57) ABSTRACT

A non-reciprocal circuit element (for example, a 2-port isolator) includes a tabular yoke, permanent magnets, a ferrite to which a direct current magnetic field is applied from the permanent magnets, a first center electrode and a second center electrode disposed on the ferrite, and a circuit board. The tabular yoke is disposed on the upper surface of a ferrite magnet assembly with a dielectric layer therebetween. For example, the dielectric layer could be an adhesive agent layer made of an epoxy-based resin. The above arrangement provides a non-reciprocal circuit element having a simplified structure, a stable electrical characteristic, and a high reliability is provided.

7 Claims, 13 Drawing Sheets

NON-RECIPROCAL CIRCUIT ELEMENT

BACKGROUND OF THE INVENTION

1. Field of the Invention

The present invention generally relates to a non-reciprocal circuit element and, in particular, to a non-reciprocal circuit element used in a microwave band, such as an isolator and a circulator.

2. Description of the Related Art

In general, non-reciprocal circuit elements, such as isolators and circulators, have a characteristic in which a signal is transmitted in only a predetermined particular direction and is not transmitted in the opposite direction. By using such a characteristic, for example, isolators are used in a transmission circuit unit of mobile communication devices, such as car telephones and cell phones.

In such non-reciprocal circuit elements, in order to protect an assembly body of a ferrite having a center electrode formed therein and a permanent magnet for applying a direct current magnetic field to the ferrite from an external magnetic field, the assembly body is enclosed by a ring-shaped yoke (refer to International Application Publication No. 2006/011383) or a box-shaped yoke (refer to Japanese Unexamined Patent Application Publication No. 2002-198707).

However, since existing non-reciprocal circuit elements employ a ring-shaped yoke obtained by processing a soft iron or a box-shaped yoke for a magnetic shield component, the processing and assembly requires a large number of steps, and therefore, the manufacturing cost is increased. In addition, since a yoke is present around a ferrite and a permanent magnet, the outer shape of the non-reciprocal circuit element is increased in size. In contrast, if the size of the outer shape of the non-reciprocal circuit element is maintained unchanged, the sizes of the ferrite and the permanent magnet are reduced, and therefore, the electrical characteristics disadvantageously deteriorate. This is because, if the size of the ferrite is reduced, the size of the center electrode is also reduced, and therefore, the inductance value and the Q value are decreased.

In addition, since the yoke is in contact with or in close proximity to a circuit board, a floating capacitance is generated between the yoke and an internal electrode of the circuit board. Thus, a variation in the electrical characteristic of the non-reciprocal circuit element occurs. Furthermore, in the case in which a yoke made of a soft iron is soldered onto a ceramic circuit board, a heat stress acts on a soldered portion due to heat generated when the non-reciprocal circuit element operates, since the linear expansion coefficient of a soft iron is two to ten times that of a ceramic. Thus, the circuit board may curl, cracks may form in the circuit board, or the soldered portion may break. As a result, the reliability of the non-reciprocal circuit element is decreased.

SUMMARY OF THE INVENTION

In view of the above problems, preferred embodiments of the present invention provide a non-reciprocal circuit element having a simplified structure, a stable electrical characteristic, and a high reliability.

According to a preferred embodiment of the present invention, a non-reciprocal circuit element preferably includes permanent magnets, a ferrite, where a direct current magnetic field is applied to the ferrite by the permanent magnet, a first center electrode disposed on the ferrite, where one end of the first center electrode is electrically connected to an input port and the other end of the first center electrode is electrically connected to an output port, a second center electrode disposed on the ferrite, where the second center electrode intersects with the first center electrode while being electrically insulated from the first center electrode, one end of the second center electrode is electrically connected to an output port, and the other end of the first center electrode is electrically connected to a ground port, a first matching capacitor electrically connected between the input port and the output port, a second matching capacitor electrically connected between the output port and the ground port, a resistor electrically connected between the input port and the output port, and a circuit board having a terminal electrode arranged on a surface thereof. The ferrite and the permanent magnets define a ferrite magnet assembly in which the permanent magnets sandwich the ferrite to be parallel or substantially parallel to a surface of the ferrite having the first and second center electrodes disposed thereon. The ferrite magnet assembly is disposed on the circuit board so that the surface of the ferrite having the first and second center electrodes is perpendicular or substantially perpendicular to the surface of the circuit board, and a planar yoke is disposed on the upper surface of the ferrite magnet assembly with a dielectric layer therebetween.

According to the non-reciprocal circuit element of a preferred embodiment of the present invention, a 2-port lumped constant isolator having low insertion loss can be obtained. In addition, since the planar yoke is disposed immediately above the ferrite magnet assembly with the dielectric layer therebetween, the yoke can be significantly simplified. Accordingly, the ferrite magnet assembly can be very easily manufactured and manipulated, as compared with an existing soft-iron yoke surrounding a ferrite magnet assembly. In addition, since the need for a yoke disposed in the vicinity of the ferrite magnet assembly is eliminated, the outer shape of the non-reciprocal circuit element can be reduced in size, and/or the ferrite magnet assembly can be increased in size. Consequently, the electrical characteristics can be improved. In particular, since the center electrode is increased in size, the inductance value and the Q value can be increased.

In addition, the planar yoke is not physically joined to the circuit board. Accordingly, damage of the circuit board due to thermal expansion of the yoke can be prevented, and therefore, the reliability can be increased. Furthermore, a gap defined by an appropriate air layer is provided between the yoke and a surface of the circuit board. Accordingly, negligible floating capacitance is defined between the yoke and an internal electrode incorporated in the circuit board. As a result, stable electrical properties of the non-reciprocal circuit element can be obtained.

According to a preferred embodiment of the present invention, it is desirable that the first and second central electrodes are arranged on the ferrite and intersect with each other at a predetermined angle while being electrically insulated from each other. The first and second central electrodes can be stably formed more accurately using a thin-film forming technology, such as a photolithographic method, for example.

In addition, it is desirable that the thickness of the dielectric layer ranges from about 0.02 mm to about 0.10 mm, for example. The thickness of the dielectric layer in this range can reduce a leakage magnetic flux and provide a direct current bias magnetic flux density having an excellent intensity distribution. The effect of a thickness in this range is described in more detail below with reference to FIGS. 10 to 17.

Furthermore, an adhesive agent layer can be suitably included in the dielectric layer disposed between the ferrite magnet assembly and the planar yoke. In order to increase heat resistance, it is desirable that an epoxy-based resin is used for the adhesive agent layer, for example.

An end portion of the planar yoke may be bent in either direction perpendicular, substantially perpendicular, parallel, or substantially parallel to the magnetic bias direction from the permanent magnet to the ferrite. By providing such a bent portion, increased magnetic utilization of the permanent magnet can be obtained.

According to a preferred embodiment of the present invention, since the planar yoke is disposed immediately above the ferrite magnet assembly with the dielectric layer therebetween, the structure of the yoke can be simplified. Accordingly, an increase in the size of the element and deterioration of the electrical characteristics can be prevented. In addition, a floating capacitance between the yoke and a surface of the circuit board rarely occurs. Thus, the electrical characteristics can be stabilized. Furthermore, the risk of damage of the circuit board due to heat stress can be eliminated, and therefore, the reliability can be increased.

Other features, elements, steps, characteristics and advantages of the present invention will become more apparent from the following detailed description of preferred embodiments of the present invention with reference to the attached drawings.

DETAILED DESCRIPTION OF THE PREFERRED EMBODIMENTS

Non-reciprocal circuit elements according to various preferred embodiments of the present invention are described below with reference to the accompanying drawings.

First Preferred Embodiment (FIGS. 1 to 9)

Figure 1:
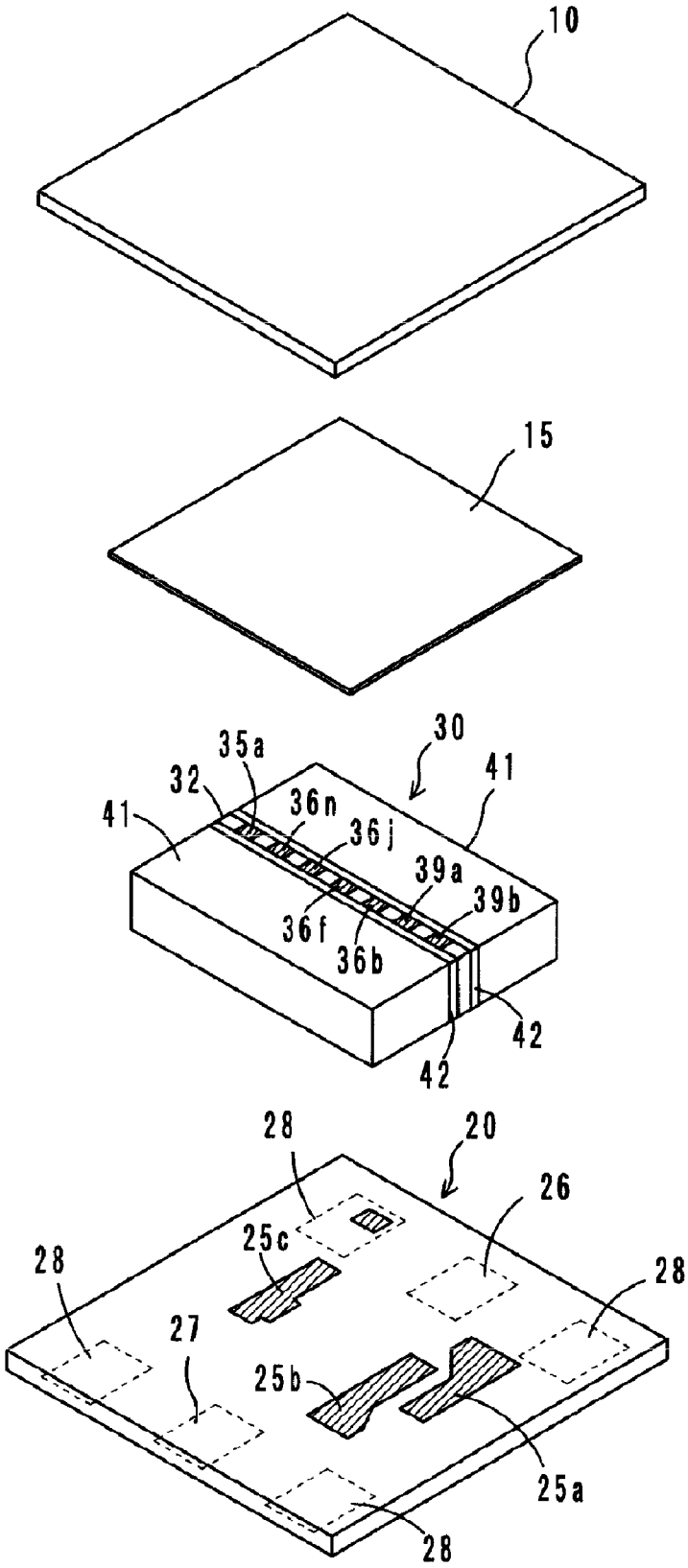
FIG. 1 is an exploded perspective view of a non-reciprocal circuit element (a 2-port isolator) according to a first preferred embodiment of the present invention.

FIG. 1 is an exploded perspective view of a 2-port isolator, which is a first preferred embodiment of a non-reciprocal circuit element according to the present invention. The 2-port isolator is a lumped constant isolator. The 2-port isolator primarily includes a tabular yoke 10, a circuit board 20, and a ferrite magnet assembly 30 defined by a ferrite 32 and permanent magnets 41. In FIG. 1, a portion with hatchings indicates a conductor body.

Figure 2:
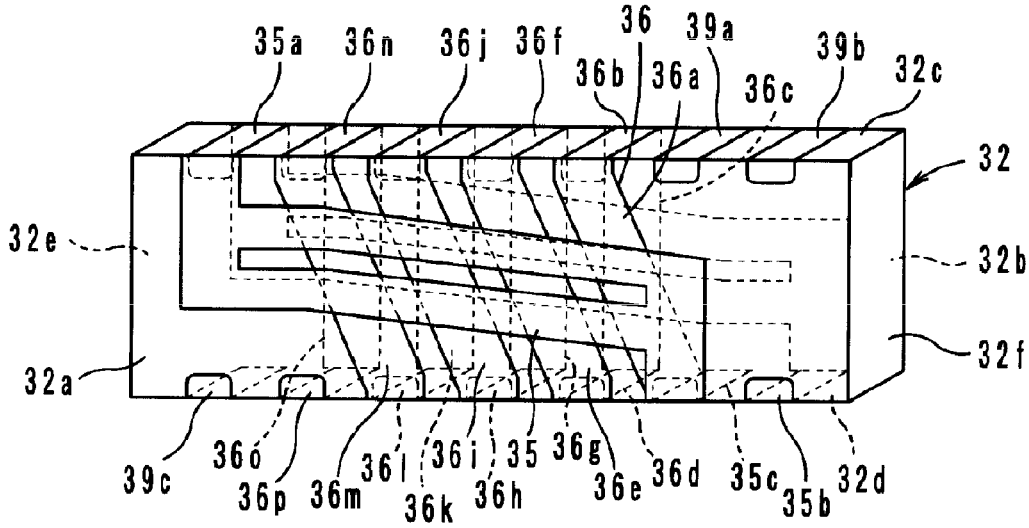
FIG. 2 is a perspective view of a ferrite having center electrodes in accordance with a preferred embodiment of the present invention.
Figure 3:
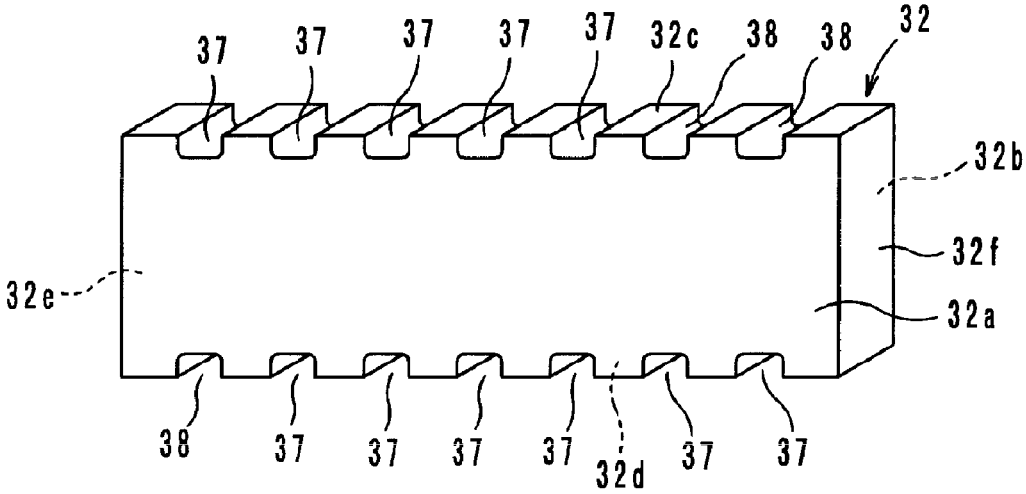
FIG. 3 is a perspective view of the ferrite in accordance with a preferred embodiment of the present invention.

As shown in FIG. 2, a first center electrode 35 and a second center electrode 36 that are electrically insulated are defined on a front principal surface 32*a* and a back principal surface 32*b* of the ferrite 32. In this example, the ferrite 32 is preferably a rectangular parallelepiped having the first principal surface 32*a* and the second principal surface 32*b* parallel or substantially parallel to each other. The ferrite 32 further has an upper surface 32*c*, a lower surface 32*d*, and end surfaces 32*e* and 32*f*.

Figure 4:
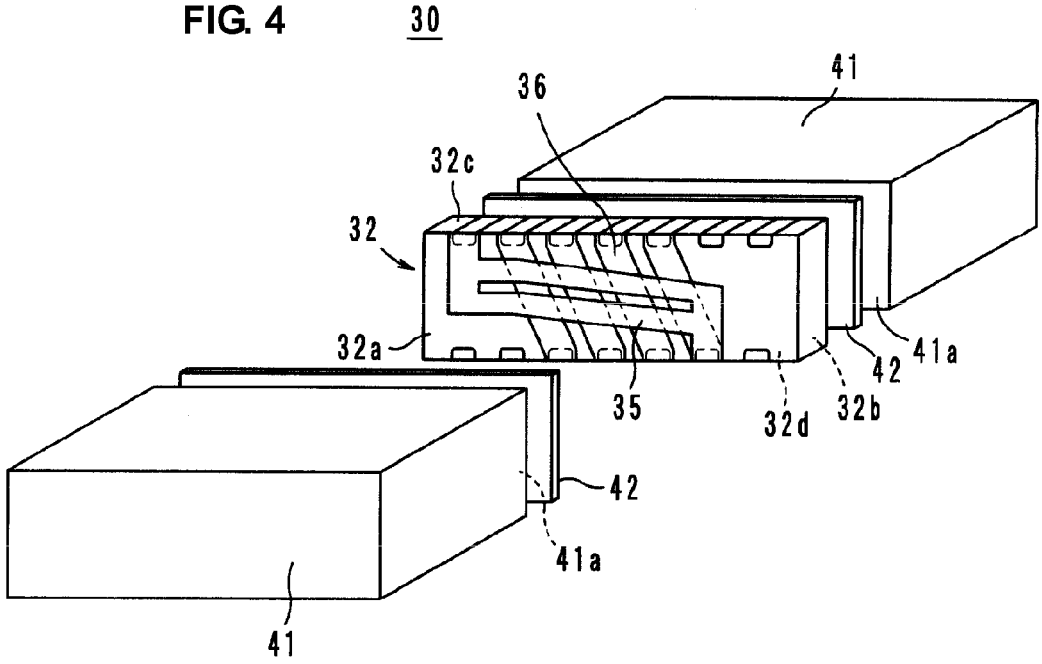
FIG. 4 is an exploded perspective view of a ferrite magnet assembly in accordance with a preferred embodiment of the present invention.

In addition, the permanent magnets 41 are bonded to either of the principal surfaces 32*a* and 32*b* of the ferrite 32 using, for example, an epoxy-based adhesive agent 42 so that the magnetic field is applied to the principal surfaces 32*a* and 32*b* in a direction perpendicular or substantially perpendicular to the principal surfaces 32*a* and 32*b* (refer to FIG. 4). Thus, the ferrite magnet assembly 30 is defined. The dimensions of principle surfaces 41*a* of the permanent magnets 41 are preferably the same as those of the principal surfaces 32*a* and 32*b* of the ferrite 32. The principal surface 32*a* opposes the principle surface 41*a* of one of the permanent magnets 41 so that the outlines thereof are substantially aligned with each other, and the principal surface 32*b* opposes the principle surface 41*a* of the other permanent magnet 41 so that the outlines thereof are substantially aligned with each other.

As shown in FIG. 2, the first center electrode 35 is arranged to extend from the lower right to the upper left on the first principal surface 32*a* of the ferrite 32 while branching into two segments. The first center electrode 35 is preferably inclined at a relatively small angle relative to the upper long side of the first principal surface 32*a*. The first center electrode 35 further extends onto the second principal surface 32*b* around a relay electrode 35*a* defined on the left of the upper surface 32*c*. The first center electrode 35 extends on the second principal surface 32*b* while branching into two segments so as to overlap with the first center electrode 35 on the first principal surface 32*a* when viewed in perspective. One end of the first center electrode 35 is connected to a connection electrode 35*b* arranged on the lower surface 32*d*. The other end of the first center electrode 35 is connected to a connection electrode 35*c* arranged on the lower surface 32*d*. In this way, the first center electrode 35 is wound around the ferrite 32 for one turn. In addition, the first center electrode 35 intersects with the second center electrode 36 described below so as to be electrically insulated by an insulating film disposed therebetween.

The second center electrode 36 is arranged to extend from the lower right to the upper left on the first principal surface 32*a* of the ferrite 32. First, a half turn 36*a* of the second center electrode 36 is preferably inclined at a relatively large angle with respect to the upper long side of the first principal surface 32*a*. The second center electrode 36 further extends onto the second principal surface 32*b* around a relay electrode 36*b* defined on the upper surface 32*c* to define a first turn 36*c*. The 1st turn 36*c* substantially perpendicularly intersects with the first center electrode 35 on the second principal surface 32*b*. The lower end portion of the 1st turn 36*c* extends onto the first principal surface 32*a* around a relay electrode 36*d* defined on the lower surface 32*d* so as to define a 1.5th turn 36*e*. The 1.5th turn 36*e* extends parallel or substantially parallel to the 0.5th turn 36*a* and intersects with the first center electrode 35 on the first principal surface 32*a*. The 1.5th turn 36*e* further extends onto the second principal surface 32*b* through a relay electrode 36*f* defined on the upper surface 32*c* so as to define a 2nd turn 36*g*. In a similar way, the 2nd turn 36*g*, a relay electrode 36*h*, a 2.5th turn 36*i*, a relay electrode 36*j*, a 3rd turn 36*k*, a relay electrode 36*l*, a 3.5th turn 36*m*, a relay electrode 36*n*, a 4th turn 36*o* are defined on the surface of the ferrite 32. In addition, one end of the second center electrode 36 is connected to the connection electrode 35*c* and the other end of the second center electrode 36 is connected to a connection electrode 36*p* defined on the lower surface 32*d*. Note that the connection electrode 35*c* functions as a connection electrode of the first center electrode 35 and a connection electrode of the second center electrode 36.

That is, the second center electrode 36 is wound around the ferrite 32 for four turns in a spiral manner. As used herein, the term "0.5 turn" refers to a portion of the second center electrode 36 extending across the first principal surface 32*a* or the second principal surface 32*b* one time. An angle defined by the center electrodes 35 and 36 is appropriately determined in order to adjust the input impedance and the insertion loss.

In addition, the connection electrodes 35*b*, 35*c*, and 36*p*, and the relay electrodes 35*a*, 36*b*, 36*d*, 36*f*, 36*h*, 36*j*, 36*l*, and 36*n* are preferably formed by applying an electrode conductive material, such as silver, silver alloy, copper, or copper alloy, for example, to recess portions 37 (refer to FIG. 3) defined on the upper surface 32*c* and the lower surface 32*d* of the ferrite 32 or filling the recess portions 37 with an electrode conductive material. Furthermore, dummy recess portions 38 extending in parallel or substantially in parallel to these electrodes are defined on the upper surface 32*c* and the lower surface 32*d*. Still furthermore, dummy electrodes 39*a*, 39*b*, and 39*c* are defined on the upper surface 32*c* and the lower surface 32*d*. Such electrodes are defined by forming through-holes in a ferrite mother board in advance, filling the through-holes with an electrode conductive material, and cutting the through-holes at cutting positions. Note that such electrodes may also be formed as conductor films disposed on the recess portions 37 and 38.

For example, a YIG ferrite is preferably used for the ferrite 32. The first center electrode 35, the second center electrode 36, and the variety of electrodes can be thick films or thin films of silver or a silver alloy formed using a printing technique, a transfer technique, or a photolithographic technique, for example. A dielectric thick film, such as glass and alumina, or a resin film, such as polyimide, for example, can be used as the insulating film disposed between the center electrodes 35 and 36. Similarly, these films can be formed using a printing technique, a transfer technique, or a photolithographic technique.

In general, the permanent magnets 41 is formed from a strontium-based, barium-based, or lanthanum cobalt-based ferrite magnet, for example. A one-component heat-curable epoxy adhesive agent can be suitably used as the adhesive agent 42 used for bonding the permanent magnets 41 to the ferrite 32. An adhesive agent of such a type has excellent working properties at room temperature. The adhesive agent excellently flows into an overall bonded portion so as to form a film having a small thickness of about 5 μm to about 25 μm, for example, and be in tight contact with the bonded portion. In addition, the adhesive agent has heat resistance. Thus, the adhesive agent does not melt or is not peeled off due to heat of a reflow. Furthermore, the adhesive agent has a good resistance to the environment. Thus, the adhesive agent has excellent reliability against heat and moisture.

The circuit board 20 is preferably a laminated board defined by forming predetermined electrodes on a plurality of dielectric sheets, stacking the sheets, and sintering the sheets. As shown by equivalent circuit diagrams in FIGS. 5 and 6, the circuit board 20 includes matching capacitors C1, C2, Cs1, Cs2, Cp1, and Cp2 and a termination resistor R arranged therein. In addition, terminal electrodes 25*a*, 25*b*, and 25*c* are arranged on the upper surface, and external connection terminal electrodes 26, 27, and 28 are arranged on the lower surface.

Figure 5:
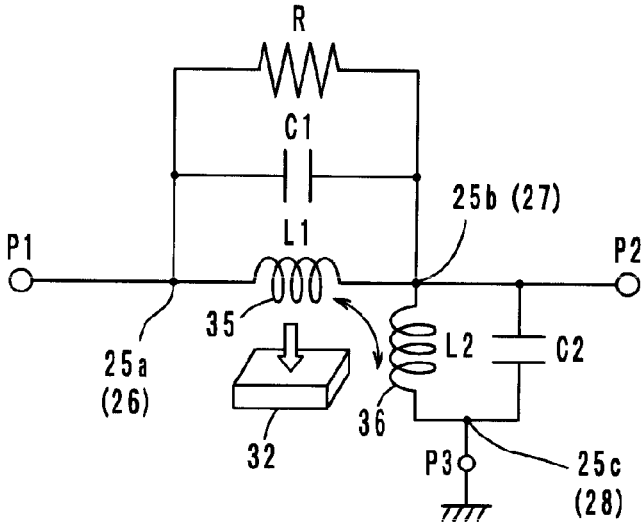
FIG. 5 is an equivalent circuit diagram of a first circuit example of the 2-port isolator in accordance with a preferred embodiment of the present invention.
Figure 6:
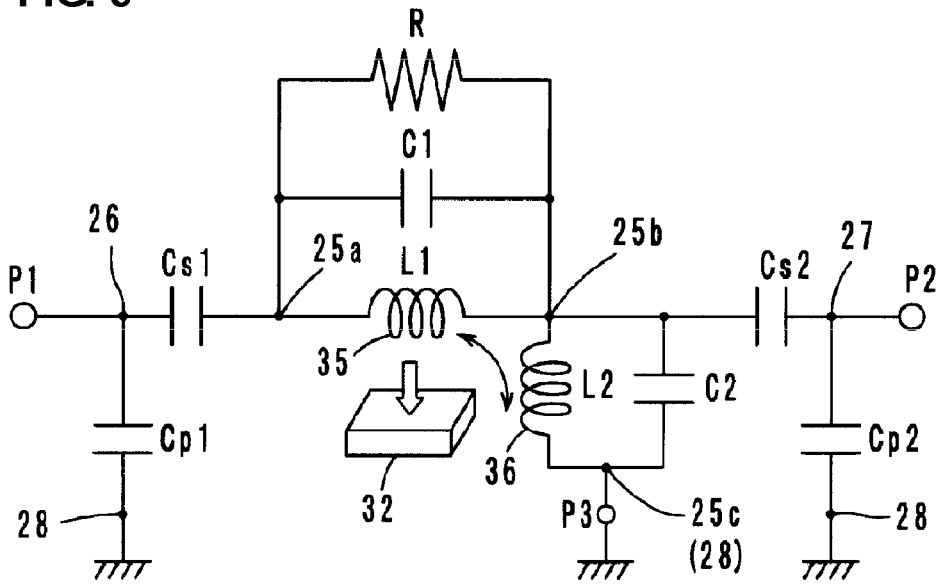
FIG. 6 is an equivalent circuit diagram of a second circuit example of the 2-port isolator in accordance with a preferred embodiment of the present invention.

The connection relationship among these matching circuit elements, the first center electrode 35, and the second center electrode 36 is shown in FIGS. 5 and 6. FIG. 5 illustrates a first circuit example, while FIG. 6 illustrates a second circuit example. The connection relationship is described next with reference to the second circuit example shown in FIG. 6.

The external connection terminal electrode 26 arranged on the lower surface of the circuit board 20 functions as an input port P1. The external connection terminal electrode 26 is connected to the matching capacitor C1 and the termination resistor R through the matching capacitor Cs1. In addition, the external connection terminal electrode 26 is connected to one end of the first center electrode 35 through the terminal electrode 25*a* arranged on the upper surface of the circuit board 20 and the connection electrode 35*b* arranged on the lower surface 32*d* of the ferrite 32.

The other end of the first center electrode 35 and one end of the second center electrode 36 are connected to the matching capacitors C1 and C2 through the connection electrode 35*c* arranged on the lower surface 32*d* of the ferrite 32 and the terminal electrode 25*b* arranged on the upper surface of the circuit board 20, and are connected to the external connection terminal electrode 27 arranged on the lower surface of the circuit board 20 through the matching capacitor Cs2. The electrode 27 functions as an output port P2.

The other end of the second center electrode 36 is connected to the matching capacitor C2 and the external connection terminal electrode 28 arranged on the lower surface of the circuit board 20 through the connection electrode 36*p* arranged on the lower surface 32*d* of the ferrite 32 and the terminal electrode 25*c* arranged on the upper surface of the circuit board 20. The electrode 28 functions as a ground port P3.

In addition, the impedance matching capacitor Cp1 that is connected to ground is connected to a connection point of the input port P1 and the capacitor Cs1. Similarly, the impedance matching capacitor Cp2 that is connected to ground is connected to a connection point of the output port P2 and the capacitor Cs2.

The ferrite magnet assembly 30 is mounted on the circuit board 20. The variety of electrodes disposed on the lower surface 32*d* of the ferrite 32 are preferably reflow-soldered to the terminal electrodes 25*a*, 25*b*, and 25*c* disposed on the circuit board 20 in an integrated fashion. In addition, the lower surfaces of the permanent magnets 41 are bonded to the circuit board 20 using an adhesive agent in an integrated fashion.

For the reflow solder, a tin-silver-copper alloy-based solder, a tin-silver-zinc alloy-based solder, a tin-zinc-bismuth alloy-based solder, a tin-zinc-aluminum alloy-based solder, or a tin-copper-bismuth alloy-based solder can be used, for example. In addition to connection using a reflow solder, connection using a solder bump, a gold bump, a conductive paste, or a conductive adhesive agent may be employed.

For an adhesive agent used for bonding the permanent magnets 41 to the circuit board 20, one-component or two-component heat curable epoxy-based adhesive agent is suitably used. That is, by using both soldering and bonding when the ferrite magnet assembly 30 is connected to the circuit board 20, reliable connection can be obtained.

For the circuit board 20, a board formed by sintering the mixture of glass, alumina, and other dielectric materials or a composite board formed from a combination of a resin and other dielectric materials or a combination of a glass and other dielectric materials is employed. For the internal and external electrodes, a thick film formed from silver or a silver alloy, a copper thick film, or a copper foil is employed. In particular, for the external connection electrodes, it is desirable that nickel having a thickness of about 0.1 μm to about 5 μm, for example, is plated on the external connection electrodes and, subsequently, gold having a thickness of about 0.01 μm to about 1 μm, for example, is plated on the external connection electrodes. This plating increases corrosion resistance, decreases solder leaching, and prevents a reduction in the strength of solder connection caused by a variety of reasons.

The tabular yoke 10 has an electromagnetic shield function. The tabular yoke 10 is preferably secured to the upper surface of the ferrite magnet assembly 30 through a dielectric layer (for example, an adhesive agent layer) 15. The tabular yoke 10 is used to reduce magnetic leakage from the ferrite magnet assembly 30, leakage of a high-frequency electromagnetic field, and a magnetic effect from the outside and to provide an area used by a vacuum nozzle when the isolator is mounted on a substrate (not shown) using a chip mounter, and the vacuum nozzle picks up the isolator. The tabular yoke 10 is not necessarily connected to ground. However, the tabular yoke 10 may be connected to ground using a solder or a conductive adhesive agent, for example. When the tabular yoke 10 is connected to ground, the effect of high-frequency shielding can be improved.

The tabular yoke 10 is formed by plating a soft iron steel sheet, a silicon steel sheet, a pure iron sheet, a nickel sheet, or a nickel-iron alloy sheet. A soft iron steel sheet, a silicon steel sheet, and a pure iron sheet have a high saturation magnetic flux density and a low remanent magnetic flux density and therefore have a large electromagnetic shield effect. In addition, adjustment of the remanent magnetic flux density of the permanent magnets 41 is facilitated, and the remanent magnetic flux density is advantageously stabilized. It is desirable to plate such a sheet with a nickel undercoat having a thickness of about 1 μm to about 5 μm, for example, and a silver overcoat having a thickness of about 1 μm to about 5 μm, for example. However, the undercoat may be copper. The silver overcoat reduces eddy current loss, and therefore, the insertion loss of the isolator can be minimized.

It is desirable that an epoxy-based resin, such as a one-component heat-curable epoxy-based adhesive agent, for example, is used for the dielectric layer 15 that secures the tabular yoke 10 to the upper surface of the ferrite magnet assembly 30. This is because the adhesive agent has an excellent heat resistance, working properties, and mechanical strength. Alternatively, an adhesive agent arranged into a sheet in advance, for example, a semi-cured heat-curable epoxy-based adhesive sheet, may be used. The adhesive agent sheet allows the thickness of the adhesive layer to be uniform, and therefore, an isolator having stable electrical properties can be produced.

The tabular yoke 10 is assembled onto the ferrite magnet assembly 30 mounted on the circuit board 20. At that time, a plurality of the tabular yokes 10 cut into a predetermined size may be individually assembled. A plurality of yokes 10 integrated into one piece and defining a collective yoke may be separated one by one and assembled onto the ferrite magnet assembly 30. Alternatively, the collective yoke 10 may be assembled onto the ferrite magnet assembly 30 mounted on a collective circuit board 20. Thereafter, the collective yoke 10 may be separated into individual yokes 10 by using, for example, a dicer. In such a method for producing a plurality of components at a time, the circuit board 20 and the tabular yoke 10 have the same outer shape.

Figure 7A:
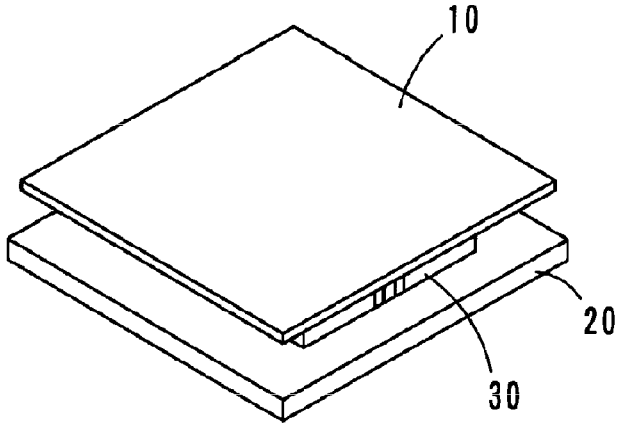
FIG. 7A is a perspective view of a circuit board, the ferrite magnet assembly, and a planar yoke integrated into one piece in accordance with a preferred embodiment of the present invention.
Figure 7B:
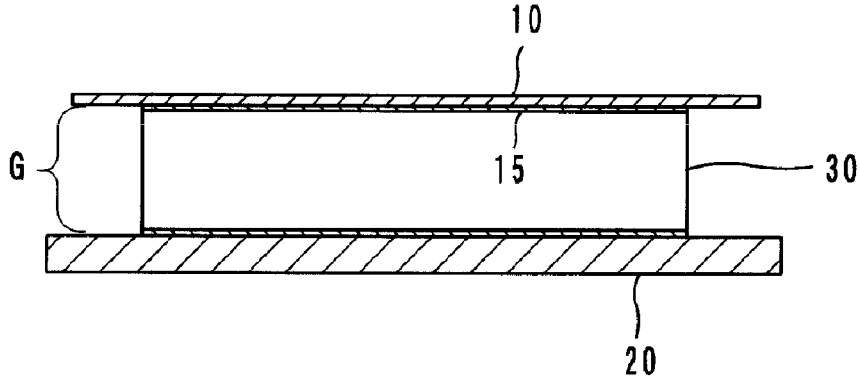
FIG. 7B is a cross-sectional view of the integrated one piece in accordance with a preferred embodiment of the present invention.
Figure 8A:
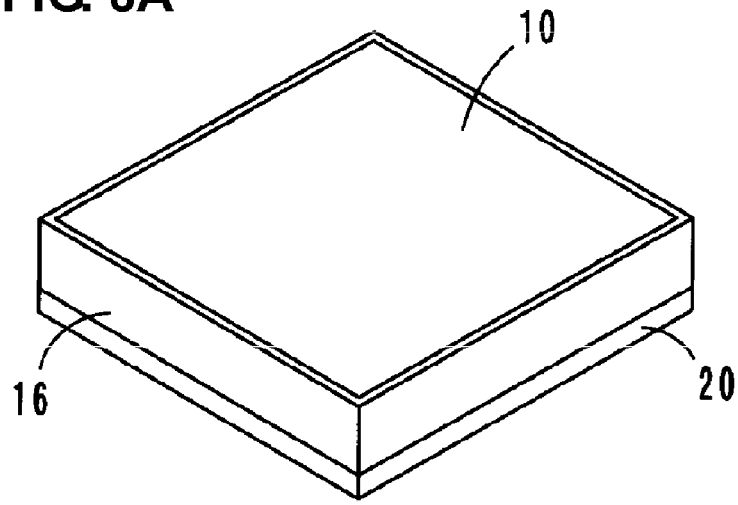
FIG. 8A is a perspective view of another example of a circuit board in accordance with a preferred embodiment of the present invention, the ferrite magnet assembly, and a planar yoke integrated into one piece.
Figure 8B:
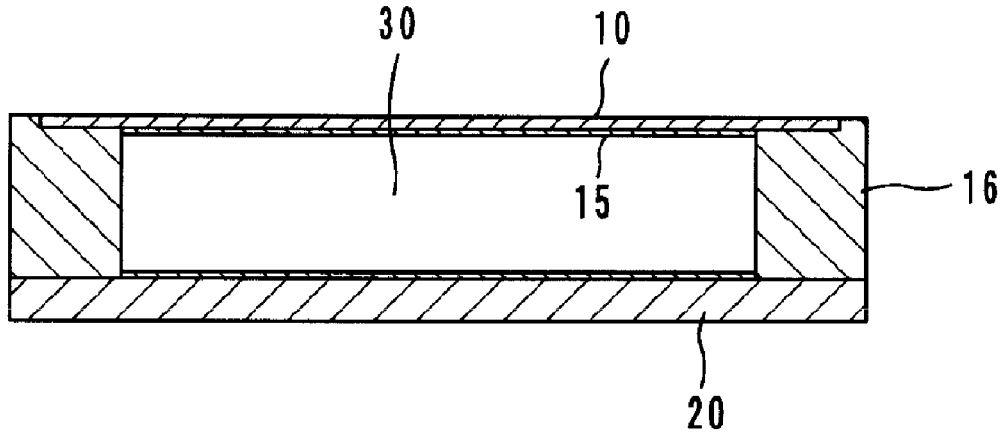
FIG. 8B is a cross-sectional view of the integrated one piece in accordance with a preferred embodiment of the present invention.

FIGS. 7A and 7B illustrate the circuit board 20, the ferrite magnet assembly 30, and the tabular yoke 10 integrated into one piece. FIGS. 8A and 8B illustrate the ferrite magnet assembly 30 surrounded by a resin 16. As can be seen from FIG. 7B, since an air gap G is defined between the circuit board 20 and the tabular yoke 10, the occurrence of a floating capacitance between the tabular yoke 10 and an internal electrode of the circuit board 20 can be prevented. Thus, the isolator can have stable electrical properties.

In a 2-port isolator having the above-described structure, one end of the first center electrode 35 is connected to the input port P1, while the other end is connected to the output port P2. One end of the second center electrode 36 is connected to the output port P2, while the other end is connected to the ground port P3. Accordingly, a 2-port lumped constant isolator having a small insertion loss can be generated. In addition, during operation, a large high-frequency current flows in the second center electrode 36, while negligible high-frequency current flows in the first center electrode 35. Therefore, the direction of the high-frequency magnetic field generated by the first center electrode 35 and the second center electrode 36 is determined by the layout of the second center electrode 36. Since the direction of the high-frequency magnetic field can be determined, a method for decreasing the insertion loss can be easily implemented.

In addition, since the tabular yoke 10 is disposed immediately above the ferrite magnet assembly 30 with the dielectric layer 15 therebetween, the need for a soft iron yoke having a ring shape or a box shape that is required for existing isolators can be eliminated. Thus, the tabular yoke 10 can be easily produced and manipulated. Thus, the total cost can be reduced. Furthermore, since the tabular yoke 10 is not mechanically joined to the circuit board 20, damage of the circuit board 20 due to heat stress can be prevented. Thus, the reliability can be increased. Still furthermore, since the air gap G is defined between the tabular yoke 10 and a surface of the circuit board 20, a floating capacitance is rarely generated, as described above.

Furthermore, the need for a yoke that surrounds the ferrite magnet assembly 30 and that is required for existing isolators can be eliminated. Accordingly, the size of the outer shape can be reduced. Alternatively, the size of the outer shape of the ferrite magnet assembly 30 can be increased. Therefore, the electrical properties can be improved. In particular, when the sizes of the first center electrode 35 and the second center electrode 36 are increased, the inductance value and the Q value are increased.

Still furthermore, in the ferrite magnet assembly 30, since the ferrite 32 and a pair of the permanent magnets 41 are integrated into one piece using an adhesive agent 42, the ferrite magnet assembly 30 is mechanically stabilized. Thus, a rigid isolator that does not deform and is not damaged by vibration or a shock can be achieved.

In this isolator, the circuit board 20 is preferably a multi-layer dielectric board. Accordingly, the circuit board 20 can include a circuit network having capacitors and resistors therein. As a result, the size and thickness of the isolator can be reduced. In addition, since connection between the circuit components can be made inside the board, the reliability can be increased. It should be noted that the circuit board 20 does not necessarily have a multi-layer structure. For example, the circuit board 20 may have a single-layer structure, or matching capacitor chips may be externally mounted on the board.

Figure 9A:
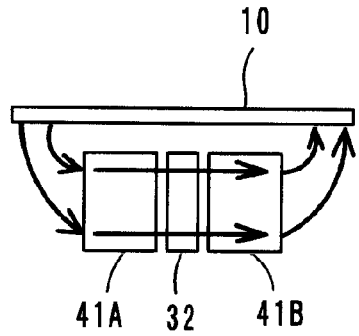
FIGS. 9A and 9B are diagrams illustrating a flow of a direct current magnetic flux emanating from a permanent magnet and acting on the ferrite in accordance with a preferred embodiment of the present invention.
Figure 9B:
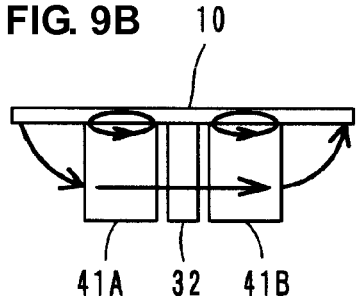

A magnetic flux flow occurring when the tabular yoke 10 is employed is described next. As shown in FIG. 9A, in a bias magnetic field emanating from a permanent magnet 41A and acting on the ferrite 32, the magnetic flux emanating from a side surface of a permanent magnet 41B enters the yoke 10, circulates inside the yoke 10, and returns to a side surface of the permanent magnet 41A. As shown in FIG. 9B, when the tabular yoke 10 is in direct contact with the upper surfaces of the permanent magnets 41A and 41B, a magnetic circuit is short-circuited, and therefore, the magnetic field distribution inside the ferrite 32 becomes non-uniform. In order to eliminate the non-uniformity of the magnetic field distribution, a magnetic gap needs to be formed in the short-circuited portion of the magnetic circuit. According to the present preferred embodiment, the dielectric layer 15 is provided to solve this problem.

In addition, in order to make the isolator to be low-profile, it is desirable that the thickness of the tabular yoke 10 is small. However, if the thickness of the tabular yoke 10 is too small, the magnetic flux density inside the tabular yoke 10 increases. If the magnetic flux density exceeds the saturation magnetic flux density, the occurrence of magnetic flux leakage increases, and therefore, a magnetic resistance increases. To solve this problem, more powerful and larger permanent magnets 41 are required. Accordingly, it is desirable that the thickness of the tabular yoke 10 preferably ranges from about 0.02 mm to about 0.2 mm, for example. However, the thickness is not limited to this range.

The thickness of the dielectric layer 15 is described next. That is, by setting the thickness of the dielectric layer 15 disposed between the ferrite magnet assembly 30 and the tabular yoke 10 to a value within a predetermined range described below, a leakage magnetic flux can be reduced. In addition, a direct-current bias magnetic flux density having an excellent intensity distribution can be realized.

Figure 10:
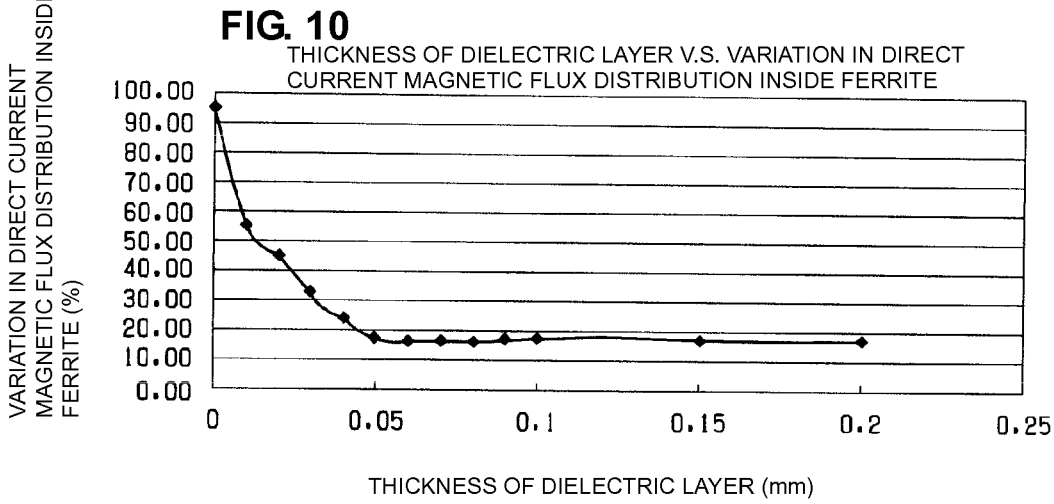
FIG. 10 is a graph illustrating a relationship between the thickness of dielectric layer and a variation in the direct current magnetic flux distribution inside the ferrite in accordance with a preferred embodiment of the present invention.

More specifically, it is desirable that the thickness of the dielectric layer 15 is preferably greater than or equal to about 0.02 mm, for example. As shown in FIG. 10, this thickness value can reduce a variation in the direct-current bias magnetic flux density to a value less than or equal to 50% inside the ferrite 32. If the variation in the direct-current bias magnetic flux density exceeds 50% inside the ferrite 32, it is difficult for the isolator to operate satisfactorily. As used herein, the term "variation in the direct-current bias magnetic flux density" refers to a value obtained by dividing a minimum magnetic flux density by a maximum magnetic flux density inside the ferrite 32.

Figure 11:
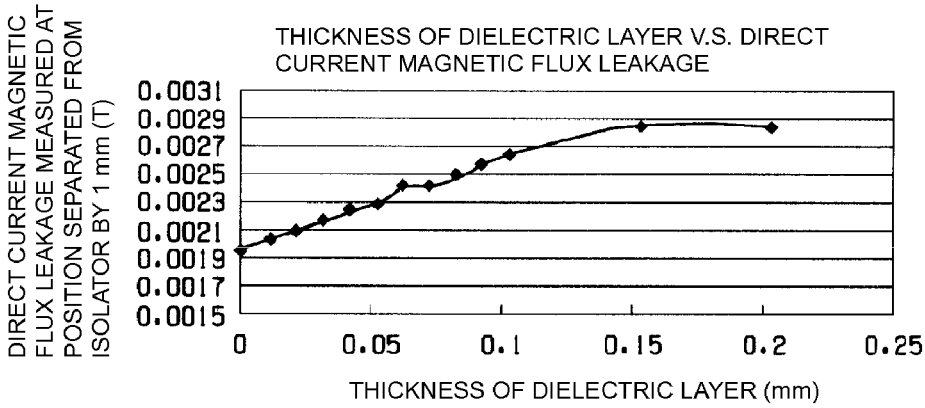
FIG. 11 is a graph illustrating a relationship between the thickness of a dielectric layer and direct current magnetic flux leakage in accordance with a preferred embodiment of the present invention.

In addition, it is desirable that the thickness of the dielectric layer 15 is preferably less than or equal to about 0.1 mm, for example. As shown in FIG. 11, this thickness value can reduce the magnetic flux leakage measured at a position separated from the isolator by 1 mm to a value less than or equal to about 0.0027 T (tesla), for example. As can be seen from FIG. 11, as the thickness of the dielectric layer 15 increases, the magnetic flux leakage towards the side of the isolator increases. When the thickness of the dielectric layer 15 is about 0.2 mm, the magnetic flux leakage is saturated. At that time, in effect, the magnetic flux leakage is the same as that without providing the yoke 10. That is, when the thickness of the dielectric layer 15 is greater than about 0.1 mm, the leakage of the magnetic flux increases, and therefore, the function of the yoke 10 disappears.

Figure 12:
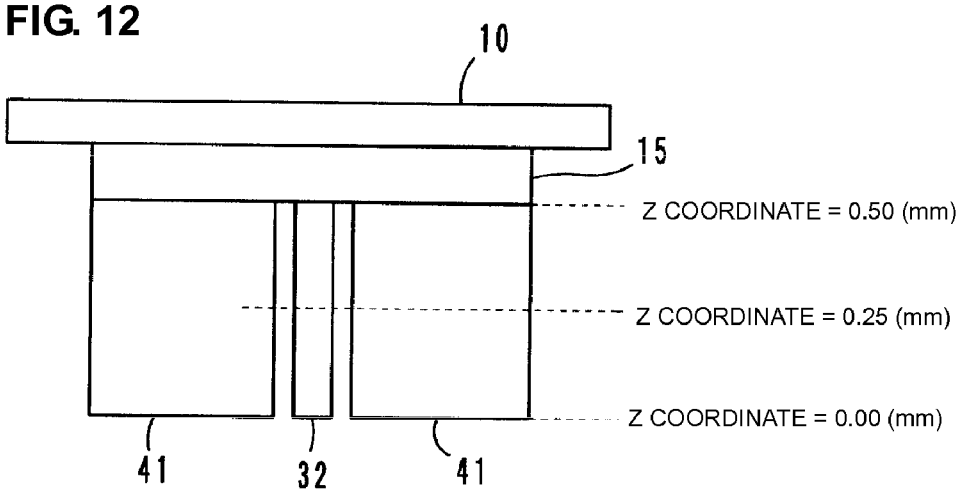
FIG. 12 is a schematic illustration of a main portion of the isolator in accordance with a preferred embodiment of the present invention.
Figure 13:
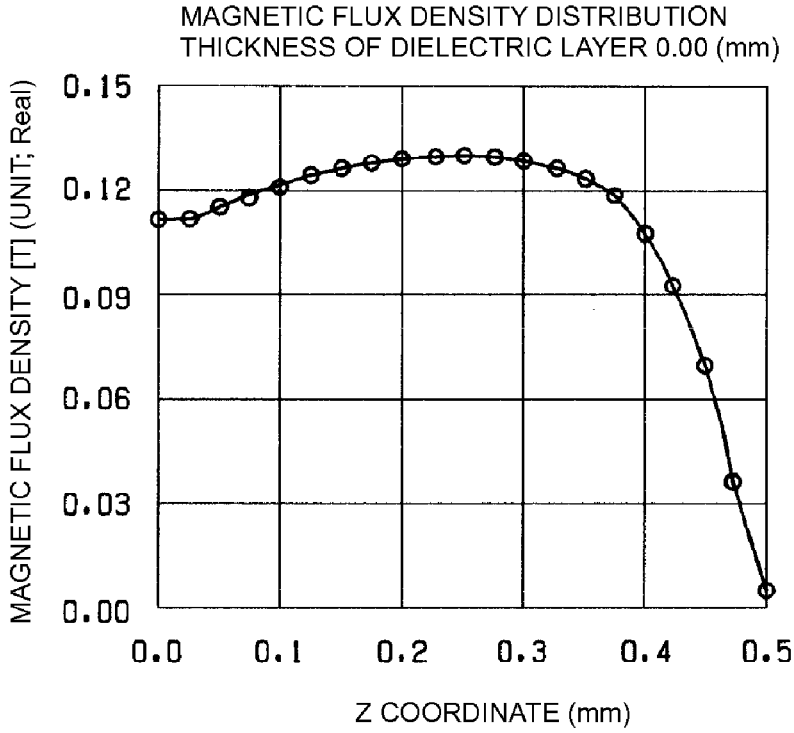
FIG. 13 is a graph illustrating a magnetic flux density distribution inside the ferrite when the thickness of the dielectric layer is 0.00 mm (i.e., no dielectric layer).
Figure 14:
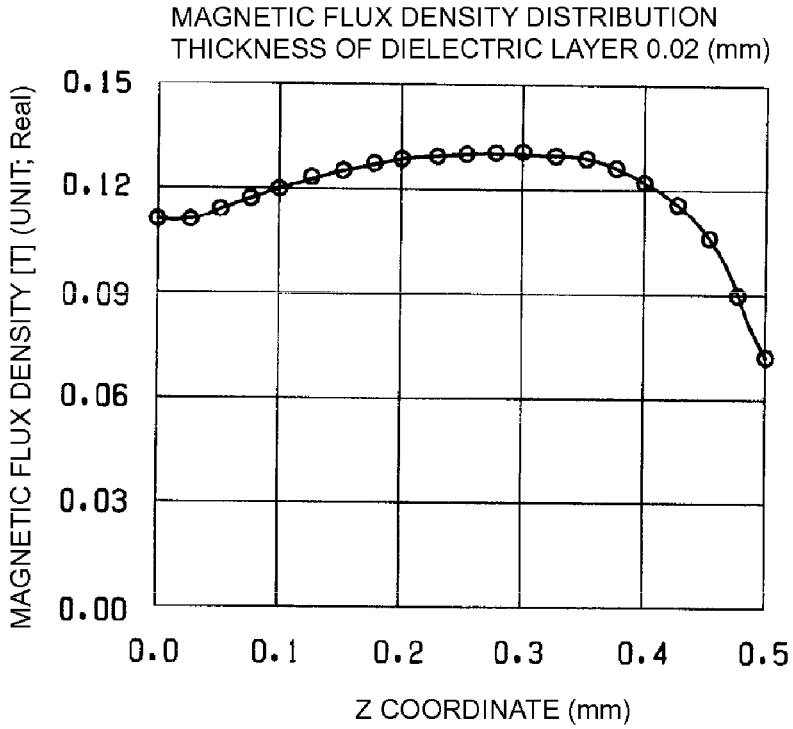
FIG. 14 is a graph illustrating a magnetic flux density distribution inside the ferrite when the thickness of the dielectric layer is about 0.02 mm.
Figure 15:
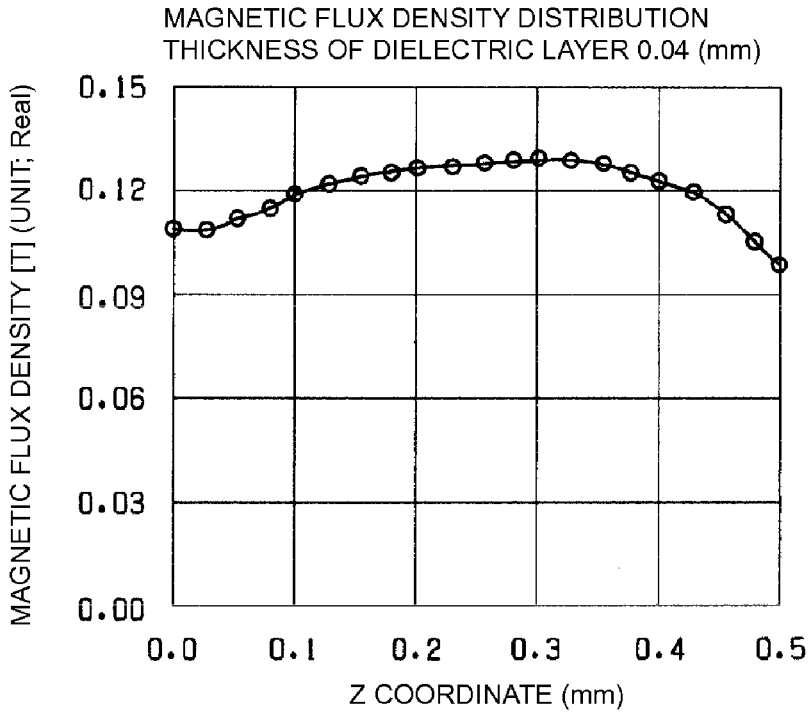
FIG. 15 is a graph illustrating a magnetic flux density distribution inside the ferrite when the thickness of the dielectric layer is about 0.04 mm.
Figure 16:
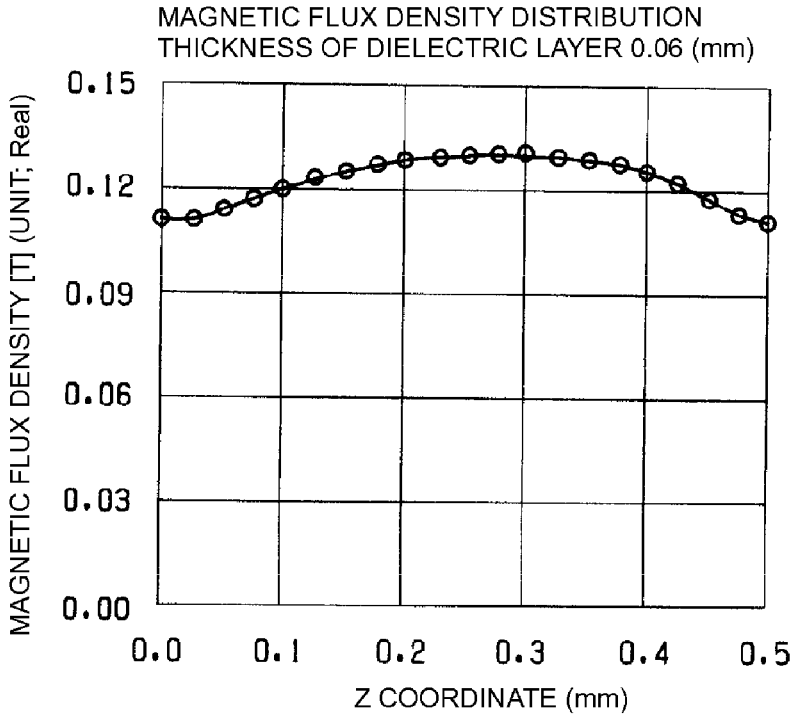
FIG. 16 is a graph illustrating a magnetic flux density distribution inside the ferrite when the thickness of the dielectric layer is about 0.06 mm.
Figure 17:
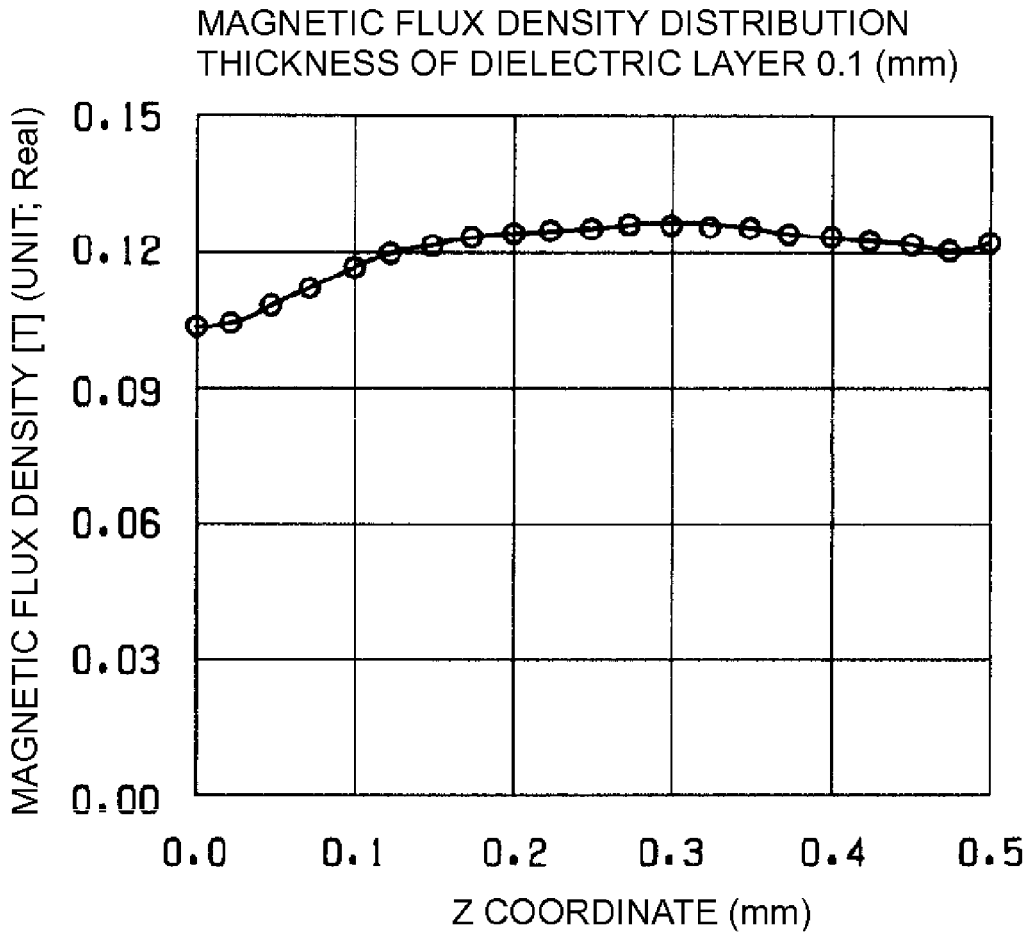
FIG. 17 is a graph illustrating a magnetic flux density distribution inside the ferrite when the thickness of the dielectric layer is about 0.10 mm.

FIG. 12 is a schematic illustration of the ferrite 32, the permanent magnets 41, the yoke 10, and the dielectric layer 15 according to the present preferred embodiment. In FIG. 12, the height of the ferrite 32 is denoted by the Z coordinate. FIGS. 13 to 17 illustrate the magnetic flux densities (unit: Real) in accordance with the Z coordinate when the thicknesses of the dielectric layer 15 are 0.00 mm, 0.02 mm, 0.04 mm, 0.06 mm, and 0.1 mm, respectively, for example. Here, the magnetic flux density represents the density of direct current magnetic flux provided by the permanent magnets 41 at a middle point of the thickness of the ferrite 32. It is ideal that the magnetic flux density is constantly 0.13 T (tesla) at any height (any Z coordinate position) in the ferrite 32. However, it is practical if the magnetic flux density is greater than about 0.1 T, for example.

It is desirable that the magnetic flux densities shown in FIGS. 14 to 17 are substantially the same at any Z coordinate position, and variations are small. This is because, if a portion in which the magnetic flux density is less than the optimum direct-current magnetic flux density (0.13 T) in the ferrite 32, the high-frequency magnetic loss increases in that portion, and therefore, the insertion loss of the isolator increases. In addition, if a portion in which the magnetic flux density is higher than the optimum direct-current magnetic flux density (0.13 T) in the ferrite 32, the magnetic permeability decreases in that portion, and therefore, the coupling between the center electrodes 35 and 36 decreases. As a result, the insertion loss of the isolator increases.

Note that the graphs shown in FIGS. 10 and 11 and FIGS. 13 to 17 are obtained by simulation using the structure shown in FIG. 1 according to the first preferred embodiment.

Ferrite: a YIG ferrite, a thickness of about 0.12 mm, a height of about 0.50 mm, a length of about 1.5 mm (the length in a depth direction in FIG. 12).

Magnet: a ferrite magnet, a thickness of about 0.45 mm, a height of about 0.50 mm, a length of about 1.5 mm (the length in a depth direction in FIG. 12)

Dielectric layer: a semi-cured epoxy-based adhesive sheet, a horizontal width of about 1.95 mm, a thickness of 0.00 to about 0.20 mm, a length of about 1.95 mm (the length in a depth direction in FIG. 12)

Yoke: a nickel-iron alloy plated with a copper undercoat and a silver overcoat, a horizontal width of about 1.95 mm, a thickness of about 0.10 mm, a length of about 1.95 mm (the length in a depth direction in FIG. 12)

Figure 18:
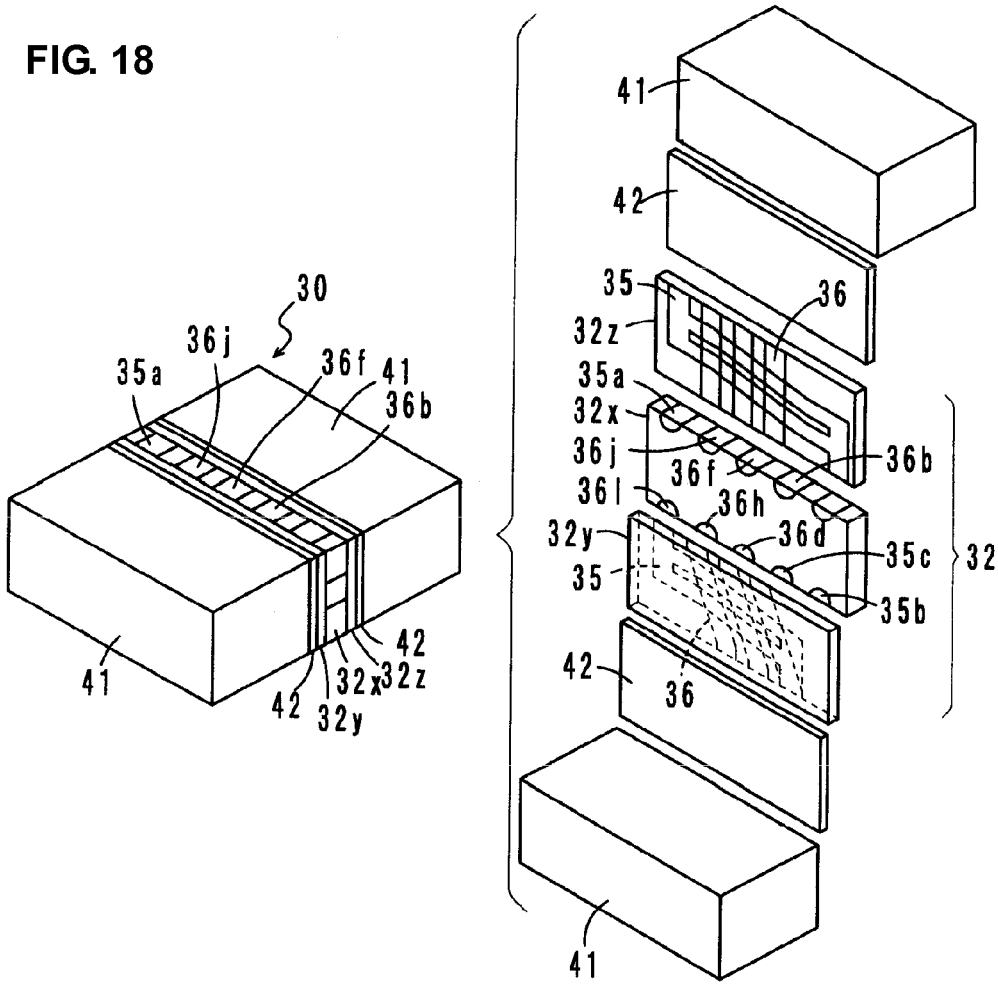
FIG. 18 is a perspective view of a ferrite magnet assembly including a center electrode according to a modification example of a preferred embodiment of the present invention.

Modification of Center Electrode (FIG. 18)

FIG. 18 illustrates a ferrite magnet assembly 30 including a first center electrode 35 and a second center electrode 36 according to a modification example of a preferred embodiment of the present invention. The first center electrode 35 and the second center electrode 36 are preferably defined by conductor films inside the ferrite 32. The second center electrode 36 is wound for three turns.

More specifically, the ferrite 32 is separated into a middle segment 32*x* and side segments 32*y* and 32*z*. The electrodes 36*b*, 36*f*, 36*j*, and 35*a* are arranged on the upper surface of the middle segment 32*x*. The electrodes 35*b*, 35*c*, 36*d*, 36*h*, and 36*l* are arranged on the lower surface of the middle segment 32*x*. The first center electrode 35 and separated portions of the second center electrode 36 are arranged from conductor films on a principal surface of each of the side segments 32*y* and 32*z*. By bonding the principle surface of the side segment 32*y* to one of the principle surfaces of the middle segment 32*x* and bonding the principle surface of the side segment 32*z* to the other principle surface of the middle segment 32*x*, the ferrite 32 including the center electrodes 35 and 36 therein can be formed. The permanent magnets 41 are bonded, using the adhesive agent 42, to the two principle surfaces of the ferrite 32 formed by using the above-described bonding procedure. In this way, the ferrite magnet assembly 30 is formed.

Figure 19:
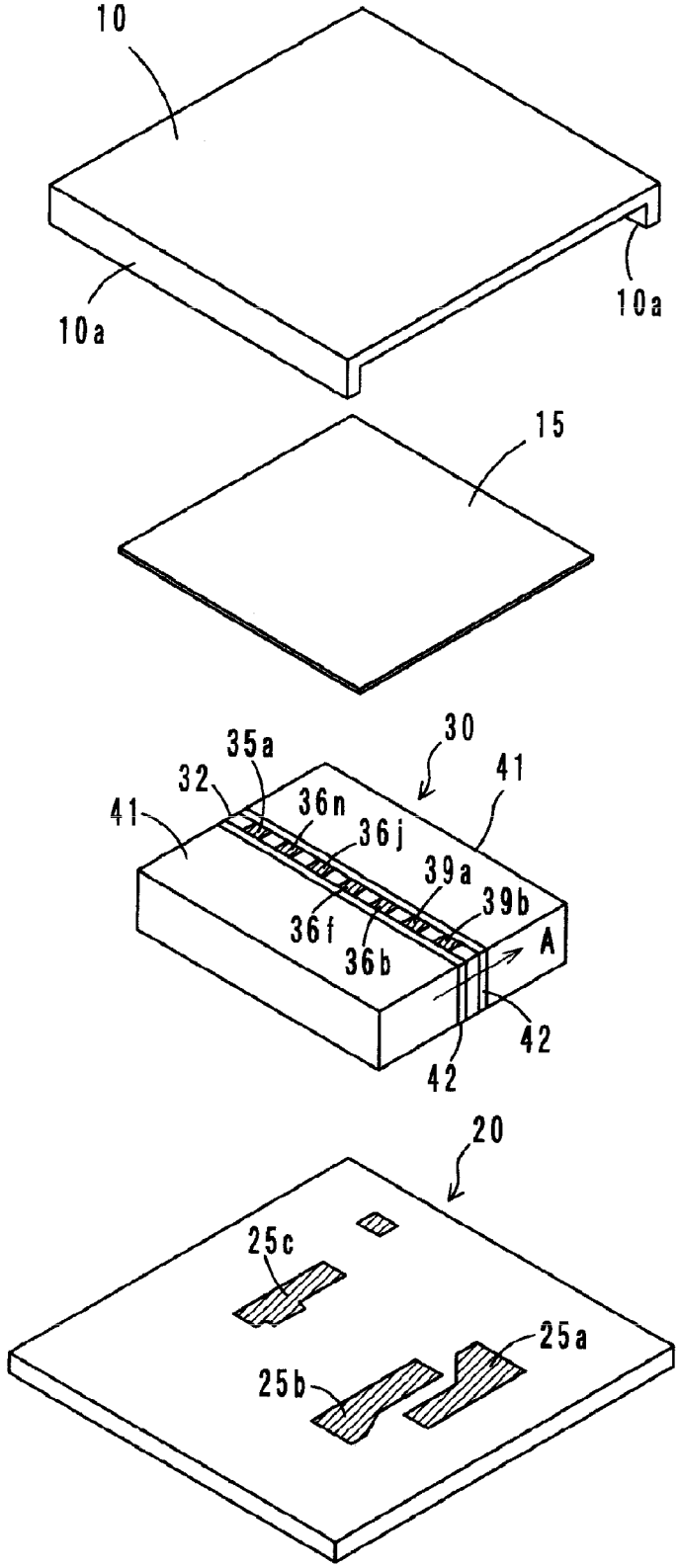
FIG. 19 is an exploded perspective view of a non-reciprocal circuit element (a 2-port isolator) according to a second preferred embodiment of the present invention.

Second Preferred Embodiment (FIG. 19)

According to a second preferred embodiment, as shown in FIG. 19, bent portions 10*a* are defined on either end of the tabular yoke 10. The other structures are similar to those of the first preferred embodiment, and therefore, the descriptions are not repeated.

More specifically, each of the bent portions 10*a* is bent towards a direction perpendicular or substantially perpendicular to the direction of a magnetic bias emanating from the permanent magnets 41 and acting on the ferrite 32 (the direction indicated by arrow A). The bent portions 10*a* receive the direct current magnetic flux emanating from the side surface perpendicular or substantially perpendicular to the magnetic bias direction of the permanent magnets 41 and cause the direct current magnetic flux to circulate inside the yoke 10. As a result, leakage of the direct current magnetic flux can be reduced, and therefore, the risk of the leakage magnetic field having a negative effect on the outside can be reduced. In addition, the magnetic resistance of the direct current magnetic circuit is reduced, and therefore, the size of the permanent magnets 41 can be reduced. As a result, the size of the isolator can be reduced.

Figure 20:
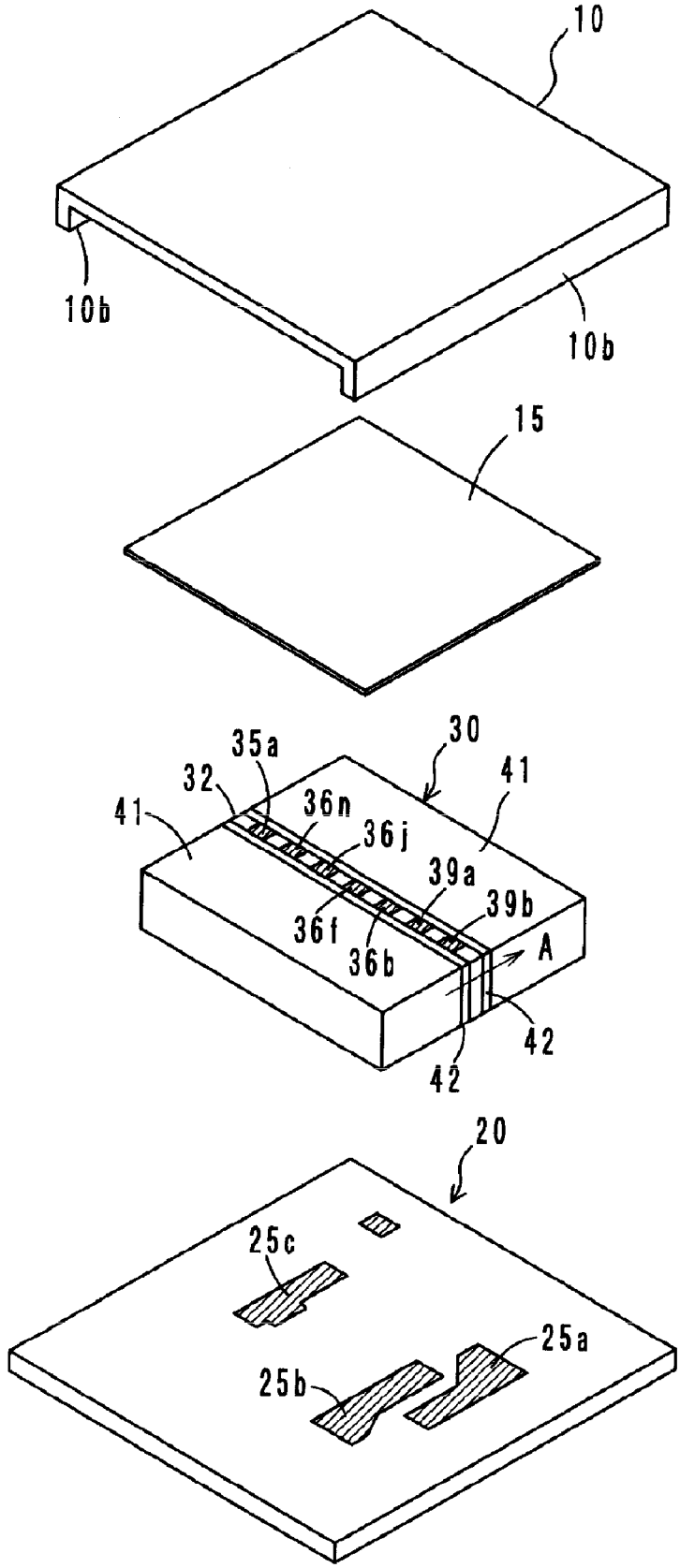
FIG. 20 is an exploded perspective view of a non-reciprocal circuit element (a 2-port isolator) according to a third preferred embodiment of the present invention.

Third Preferred Embodiment (FIG. 20)

According to a third preferred embodiment, as shown in FIG. 20, bent portions 10*b* are defined on either end of the tabular yoke 10. The other structures are similar to those of the first preferred embodiment, and therefore, the descriptions are not repeated.

More specifically, each of the bent portions 10*b* is bent towards a direction parallel or substantially parallel to the direction of a magnetic bias emanating from the permanent magnets 41 and acting on the ferrite 32 (the direction indicated by arrow A). The bent portions 10*b* can increase the cross-section of a magnetic path portion where the direct current magnetic flux circulating inside the yoke 10 is maximized. As a result, magnetic saturation of the yoke 10 can be prevented, and therefore, leakage of the direct current magnetic flux can be reduced. Thus, the risk of the leakage magnetic field having a negative effect on the outside can be reduced. In addition, since magnetic saturation rarely occurs, a thinner magnetic material plate can be used, and therefore, the isolator can be made low-profile and can be reduced in size. Furthermore, leakage of the magnetic flux from a surface parallel or substantially parallel to the magnetic bias direction can be reduced.

Other Preferred Embodiments

While the non-reciprocal circuit elements according to the present invention has been described with reference to the foregoing preferred embodiments, various modifications can be made without departing from the spirit of the present invention.

For example, by reversing the N pole and S pole of the permanent magnets 41, the input port P1 and the output port P2 can be reversed. In addition, while the foregoing preferred embodiments have been described with reference to a circuit board including all of the matching circuit elements, a chip inductor and a chip capacitor may be externally mounted on the circuit board, for example.

Furthermore, the shapes of the first center electrode 35 and the second center electrode 36 may be changed in a variety of ways. For example, while the foregoing preferred embodiments have been described with reference to the first center electrode 35 that branches into two on the principal surfaces 32*a* and 32*b* of the ferrite 32, the first center electrode 35 need not be branched. Still furthermore, the second center electrode 36 may be wound for at least one turn, for example.

As described above, the present invention can be effectively applied to a non-reciprocal circuit element. In particular, the non-reciprocal circuit element according to various preferred embodiments of the present invention is advantageous in that the non-reciprocal circuit element has a simplified structure, a stable electrical characteristic, and a high reliability.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A non-reciprocal circuit element comprising:

permanent magnets;

a ferrite arranged such that a direct current magnetic field is applied to the ferrite by the permanent magnets;

a first center electrode disposed on the ferrite, one end of the first center electrode being electrically connected to an input port, and another end of the first center electrode being electrically connected to an output port;

a second center electrode disposed on the ferrite, the second center electrode intersecting with the first center electrode while being electrically insulated from the first center electrode, one end of the second center electrode being electrically connected to an output port, the other end of the first center electrode being electrically connected to a ground port;

a first matching capacitor electrically connected between the input port and the output port;

a second matching capacitor electrically connected between the output port and the ground port;

a resistor electrically connected between the input port and the output port; and a circuit board having a terminal electrode located on a surface thereof; wherein the ferrite and the permanent magnets define a ferrite magnet assembly in which the permanent magnets sandwich the ferrite so as to be substantially parallel to a surface of the ferrite having the first and second center electrodes disposed thereon;

the ferrite magnet assembly is disposed on the circuit board so that the surface of the ferrite having the first and second center electrodes thereon is substantially perpendicular to a surface of the circuit board; and a planar yoke is disposed on an upper surface of the ferrite magnet assembly with a dielectric layer therebetween.

2. The non-reciprocal circuit element according to claim 1, wherein the first and second center electrodes include conductor films arranged on the ferrite so as to intersect with each other at a predetermined angle while being electrically insulated from each other.

3. The non-reciprocal circuit element according to claim 1, wherein a thickness of the dielectric layer is in a range from about 0.02 mm to about 0.10 mm.

4. The non-reciprocal circuit element according to claim 1, wherein an end portion of the planar yoke is bent in a direction substantially perpendicular to a direction of a magnetic bias emanating from the permanent magnet and acting on the ferrite.

5. The non-reciprocal circuit element according to claim 1, wherein an end portion of the planar yoke is bent in a direction substantially parallel to a direction of a magnetic bias emanating from the permanent magnet and acting on the ferrite.

6. The non-reciprocal circuit element according to claim 1, wherein an adhesive agent layer that is disposed between the upper surface of the ferrite magnet assembly and the planar yoke defines the dielectric layer.

7. The non-reciprocal circuit element according to claim 6, wherein the adhesive agent layer is made of an epoxy-based resin.

* * * * *